US005273215A

United States Patent [19]

Hans et al.

[11] Patent Number: 5,273,215

[45] Date of Patent: Dec. 28, 1993

[54] FUEL INJECTION VALVE

[75] Inventors: Waldemar Hans; Christian Preussner, both of Bamberg, Fed. Rep. of Germany

[73] Assignee: Robert Bosch GmbH, Stuttgart, Fed. Rep. of Germany

[21] Appl. No.: 834,244

[22] PCT Filed: Jun. 4, 1991

[86] PCT No.: PCT/DE91/00469

§ 371 Date: Feb. 19, 1992

§ 102(e) Date: Feb. 19, 1992

[87] PCT Pub. No.: WO91/19900

PCT Pub. Date: Dec. 26, 1991

[30] Foreign Application Priority Data

Jun. 21, 1990 [DE] Fed. Rep. of Germany ..... 4019752

[51] Int. Cl.[5] ..... F02M 61/18

[52] U.S. Cl. ..... 239/288.5; 239/533.2; 239/533.12; 239/585.1

[58] Field of Search ..... 239/288, 288.3, 288.5, 239/533.2, 533.12, 585.1

[56] References Cited

U.S. PATENT DOCUMENTS 4,057,190 11/1977 Kiwior et al. ..... 239/533.12 X 4,925,111 5/1990 Foertsch et al. ..... 239/533.12

4,957,241 9/1990 Roger ..... 239/585.1

FOREIGN PATENT DOCUMENTS 9004716 5/1990 World Int. Prop. O. ..... 239/533.2

*Primary Examiner*—Andres Kashnikow

*Assistant Examiner*—William Grant

*Attorney, Agent, or Firm*—Edwin E. Greigg; Ronald E. Greigg

[57] ABSTRACT

A fuel injection valve including a pan-shaped protective cap having a radially outwardly extending recess which, together with the fuel injection valve, forms a gap which is so narrow that it exerts a capillary effect on the fuel so that, when the internal combustion engine is shut down, the high boiling point constituents of the fuel are deposited at the radial outer edge of the gap, because of the capillary effect, and the injection openings remain free from deposits. The protective cap of the invention has at least three protrusions formed from its bottom and protruding in the direction of the fuel injection valve to a predetermined axial distance, the protrusions of the protective cap being in contact with the orifice plate of the fuel injection valve, forming an axial gap in a simple manner between the bottom and the orifice plate. The protective cap can be used with fuel injection valves of various types.

20 Claims, 2 Drawing Sheets

FUEL INJECTION VALVE

STATE OF THE ART

The invention is based on a fuel injection valve as set forth herein. In the German patent application P 39 27 390.3, a fuel injection valve has already been proposed in which a pan-shaped protective cap is provided. This cap has a passage opening in its bottom downstream of the at least one injection opening. The protective cap is intended to prevent damage in the region of the at least one injection opening and to avoid particles from the surroundings of the fuel injection valve, whose nozzle body protrudes into the induction pipe, from being deposited in the region of the at least one injection opening and leading to a restriction of the at least one injection opening. Such restriction would reduce the quantity of fuel injected in an undesirable manner. The narrow gap formed, by a contact section of the protective cap, between the bottom of the protective cap and an end surface of the fuel injection valve ensures that even in the case of fairly long periods of operation of the internal combustion engine, fuel deposits caused by the sequential operating and shut-down phases do not lead to the fuel quantity metered by the fuel injection valve being reduced in an undesirable manner.

If the internal combustion engine (and therefore also the fuel injection system) is shut down, the fuel injection valve is closed and fuel possibly present in the gap and the passage opening partially evaporates because of the strong heating from the internal combustion engine. In this process, only the constituents of the fuel which evaporate at relatively low temperatures are volatilised whereas the constituents which evaporate at higher temperatures are not sufficiently heated and move outwards in the gap in the radial direction because of the capillary effect of the narrow gap and are deposited there so that the at least one injection opening and the passage opening remain free from deposits.

Exact axial adjustment of the narrow gap, such as is necessary for the capillary effect, is not, however, always guaranteed by the contact section of the protective cap in accordance with the German patent application P 39 27 390.3. In addition, the manufacture of the protective cap is complicated for mass production purposes.

ADVANTAGES OF THE INVENTION

The fuel injection valve according to the invention has an advantage of simple and low-cost manufacture and the possibility of exact axial adjustment of the narrow gap, this exact adjustment being achieved in a simple manner by the protrusions. The narrow gap formed between the bottom of the protective cap and the end surface of the fuel injection valve exerts a capillary effect on the fuel and, in the case of fairly long periods of operation of the internal combustion engine, reliably prevents undesirable reduction by fuel deposits of the free flow cross-section of the at least one injection opening and the passage opening and, therefore, of the fuel quantity metered by the fuel injection valve. Advantageous extensions and improvements to the fuel injection valve given herein are possible by means of the measures listed.

It is of advantage for the protective cap to have a retention collar with at least two dimples formed in it protruding radially outwards at its end remote from the bottom. These dimples act to increase the strength of the retention collar, which acts as the side surface for a sealing ring.

It is particularly advantageous for the protective cap to be formed from a metallic material. The evaporation of the low boiling-point constituents of the fuel, which occurs after the internal combustion engine is shut down, and hence the deposit of the higher boiling-point constituents is substantially reduced by utilising the condensation effects of the fuel on the metallic protective cap.

For particularly simple and low-cost manufacture of the fuel injection valve according to the invention, it is advantageous for the protective cap to be formed by shaping sheet metal.

For a connection between the protective cap and the nozzle body which is reliable and can be manufactured in a simple manner, it is advantageous for the protective cap to be connected to the nozzle body by indentation.

For the same reason, it is also advantageous for at least two inwardly protruding engagement steps or at least two inwardly protruding retention tongues to be formed on the periphery of the protective cap, these steps or tongues engaging in an annular groove of the nozzle body.

DRAWING

Illustrative examples of the invention are shown in a simplified manner in the drawings and are explained in more detail in the following description.

Figure 3:
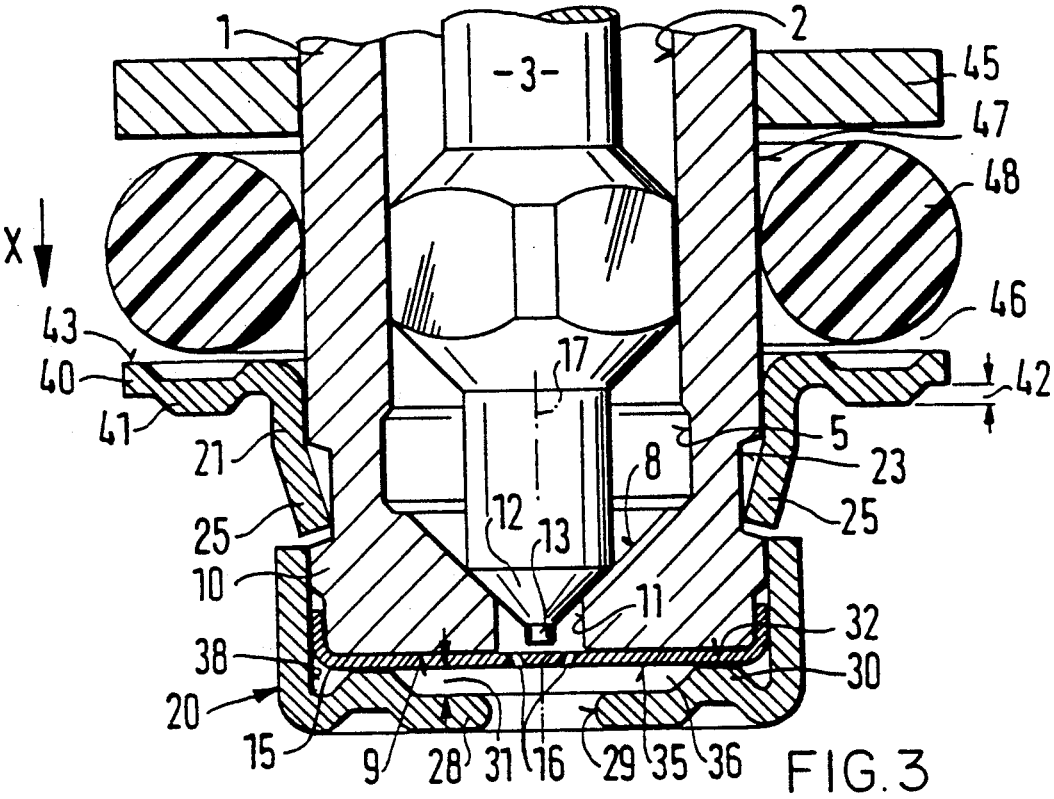
FIG. 3 illustrates a second illustrative example of a modified fuel injection valve.
Figure 4:
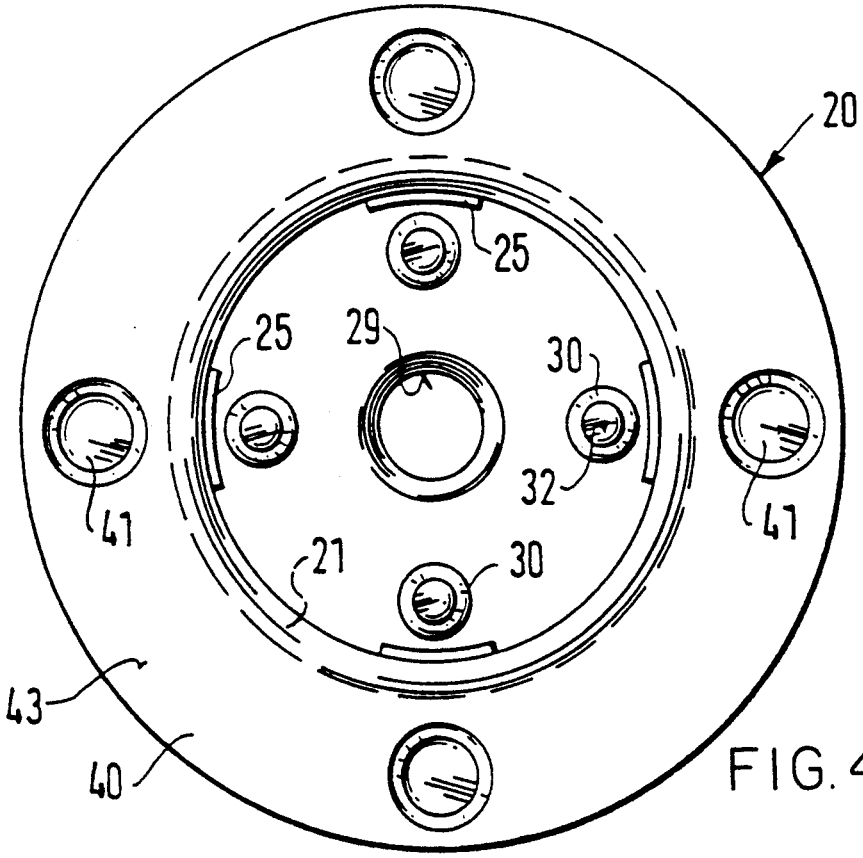

and FIG. 4 is a view in a direction of the arrow X of FIG. 3 of the protective cap for the modification shown in FIG. 3.

DESCRIPTION OF THE ILLUSTRATIVE EXAMPLES

Figure 1:
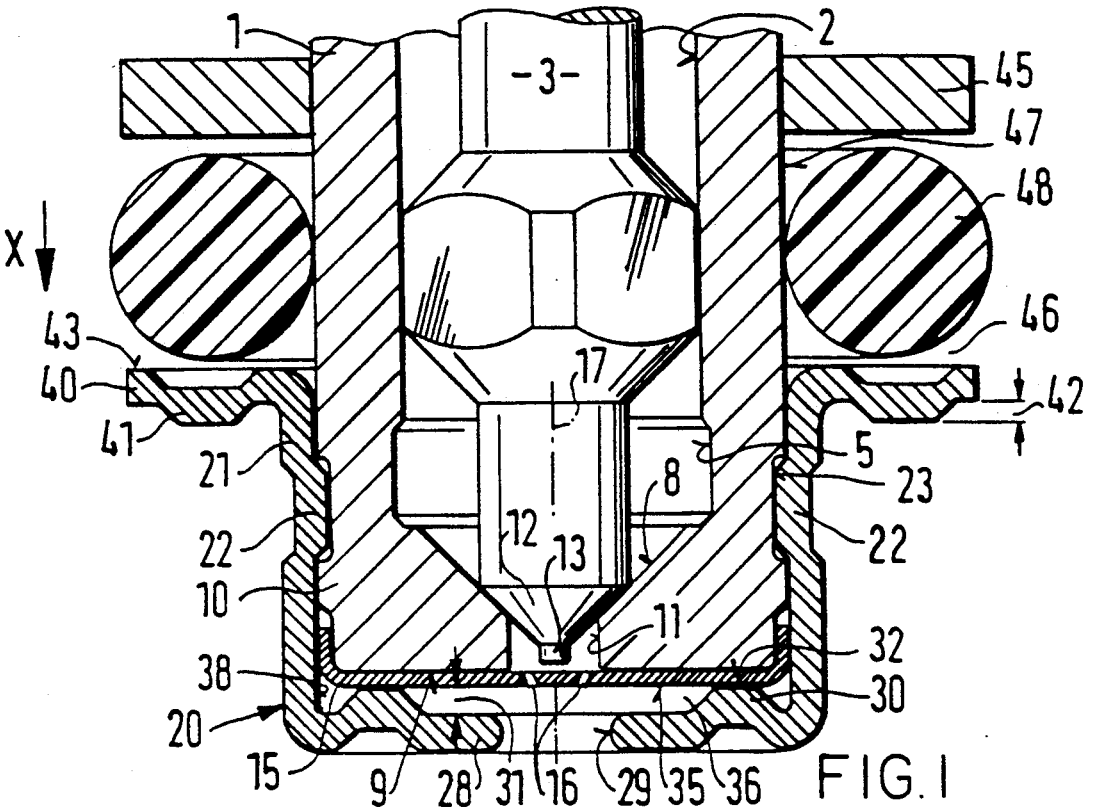
FIG. 1 shows a first illustrative example of a fuel injection valve embodied according to the invention.

The fuel injection valve shown in a partial view in FIG. 1 agrees essentially with a fuel injection valve for a fuel injection system of a mixture-compressing externally-ignited internal combustion engine described in DE-OS 37 10 467 and is used, for example, for fuel injection into the induction pipe of the internal combustion engine A nozzle body 1, in which a valve needle 3 is guided in a guide opening 2, is connected to a valve housing, which is not shown. The guide opening 2 ends, in the nozzle body 1 shown, in an undercut 5 which is followed, in the flow direction of the fuel, by a conically narrowing valve seat surface 8. A cylindrical transition opening 11 extends between the valve seat surface 8 and a nozzle body end surface 9 of a nozzle body end 10. In the region of the valve seat surface 8 of the nozzle body 1, the valve needle 3 merges into a sealing seat 12 conically narrowing in the direction of the nozzle body end surface 9, the sealing seat 12 being terminated by a cylindrical spigot 13.

In the closed condition of the fuel injection valve, the sealing seat 12 of the valve needle 3 is in contact with the valve seat surface 8 whereas, in the open condition of the fuel injection valve, the sealing seat 12 is raised from the valve seat surface 8 and fuel can flow to the transition opening 11. A thin orifice plate 15 is tightly connected to the nozzle body end surface 9 by welding or brazing, for example. This orifice plate 15 has, in its region covered by the transition opening 11, at least one injection opening 16 used for fuel metering. The two injection openings 16, shown as an example, penetrate the orifice plate 15 and are inclined, in the illustrative example shown, relative to a valve longitudinal axis 17. Depending on the type of use, they can be inclined in such a manner that the fuel jets emerging from the individual injection openings 16 are either directed inwards towards the valve longitudinal axis 17 or outwards away from the valve longitudinal axis 17. When the fuel injection valve is open, the quantity of fuel injected per unit time is metered by the cross-section of the injection openings 16. The opening of the fuel injection valve takes place electromagnetically, in a manner not shown.

The, for example, two injection openings 16 are arranged in the orifice plate 15 in such a way that they emerge from the annular space formed between the spigot 13 of the valve needle 3 and the wall of the transition opening 11, the cylindrical spigot 13 protruding almost onto the orifice plate 15 when the fuel injection valve is closed.

Pushed onto the nozzle body end 10, there is a protective cap 20 of pan-shaped design which partially surrounds the nozzle body 1 in the axial direction with a cylindrical shell 21.

Figure 2:
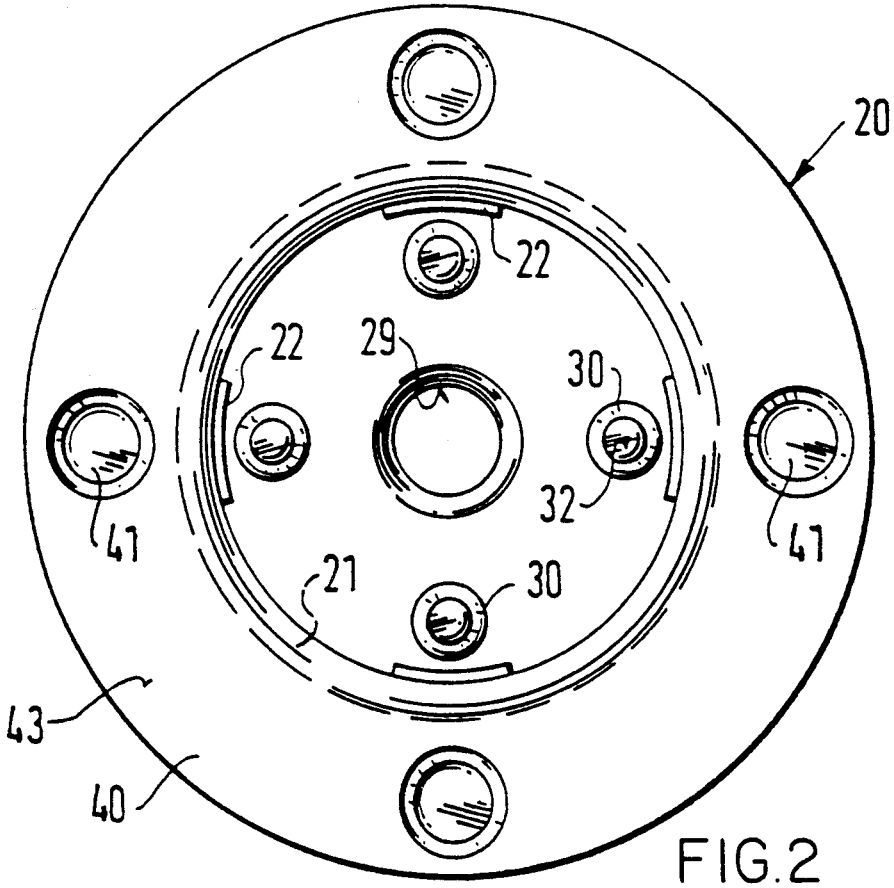
FIG. 2 shows a view in the direction of the arrow X in FIG. 1 of the protective cap in accordance with the first illustrative example.

As is indicated in the first illustrative example of the invention, shown in FIG. 1 but also in FIG. 2, which shows a view of the protective cap 20 according to the first illustrative example in the direction of the arrow X in FIG. 1, four (for example) inwardly directed engagement steps 22 are formed on the cylindrical shell 21 of the protective cap 20 and engage in an annular groove 23 of the nozzle body 1 extending, for example, peripherally and so act to fix the position of the protective cap 20 on the nozzle body 1. It is, however, also possible for the protective cap 20 to be connected to the nozzle body 1 by indentation of the material of the protective cap 20 in the region of the annular groove 23 of the nozzle body 1 in such a way that, for example, a peripheral retention collar of the protective cap 20 engages in the annular groove 23 of the nozzle body 1.

In a second illustrative example of the invention, which is shown in FIGS. 3 and 4 which differs from the first illustrative example only by the type of connection between the protective cap 20 and the nozzle body 1, at least two inwardly protruding retention tongues 25 are formed for this purpose on the cylindrical shell 21, these retention tongues 25 engaging in the, for example, peripheral annular groove 23 of the nozzle body 1.

A bottom 28 of the protective cap 20 has, concentric with the valve longitudinal axis 17, a passage opening 29 and extends in the radial direction beyond the orifice plate 15 to the cylindrical shell 21. At least three protrusions 30 are formed from the bottom 28. These are equally spaced and protrude by a predetermined axial distance 31 in the direction of the nozzle body end 10 of the nozzle body 1. In FIGS. 2 and 4, four protrusions 30 are shown as an example. The protective cap 20 is in contact with the orifice plate 15 of the fuel injection valve by means of flat or sharp-edged contact surfaces 32 of the protrusions 30. In this way, an annular gap 36 is formed between the bottom 28 of the protective cap 20 and the end surface 35, of the fuel injection valve, formed by the orifice plate 15. Because of the predetermined axial distance 31 by which the protrusions 30 protrude from the bottom 28, this annular gap 36 has an exactly definable extension in the direction of the valve longitudinal axis 17. The axial distance 31, and therefore the axial extension of the gap 36, is small relative to the diameter of the passage opening 29 of the protective cap 20. The gap 36 is subdivided into sectors by the protrusions 30.

Because of the small axial distance 31, the annular gap 36 exerts, whatever the opening condition of the fuel injection valve, such a large capillary effect on the fuel that the fuel present in the gap 36 does not flow out of the passage opening 29 because of its weight. The narrow gap 36 can, starting from the passage opening 29, extend with increasing radial direction in such a way that it either narrows or widens in the axial direction. If the internal combustion engine, and therefore also the fuel injection system, is shut down, the fuel injection valve is closed and fuel possibly present in the gap 36 and the passage opening 29 partially evaporates because of the strong heating from the internal combustion engine; only the constituents of the fuel evaporating at relatively low temperatures are volatilised whereas the constituents evaporating at higher temperatures are not sufficiently heated and move radially outwards in the annular gap 36 because of the capillary effect. These constituents are then deposited on the wall 38 of the cylindrical shell 21 so that the passage opening 29 and the orifice plate 15 remain free from fuel deposits in the region of, for example, the two injection openings 16.

At its end remote from the bottom 28, the protective cap 20 has a retention collar 40 pointing radially outwards. Four, for example, dimples 41 are formed in the retention collar 40; they are used to increase the strength of the retention collar 40 and protrude from the retention collar 40 with an axial distance 42 in the direction towards the bottom 28 of the protective cap 20.

Both the protrusions 30 and the dimples 41 can, in addition to the circular shape shown in the two illustrative examples, be formed in any other given shape, for example oval, rectangular, notch-shaped or annular.

The end surface 43 of the retention collar 40 remote from the bottom 28, together with a retention ring 45, which is located on the periphery of the nozzle body 1 remote from the nozzle body end 10, form the side surfaces of an annular groove 46 whose groove bottom 47 is formed by the periphery of the nozzle body 1. Located in the annular groove 46, there is a sealing ring 48 which permits reliable and safe sealing between the nozzle body 1 of the fuel injection valve and a valve location feature (not shown) which surrounds the fuel injection valve.

The protective cap 20 is formed, for example, from a metallic material. Because of the thermal conductivity of metallic materials, which is generally higher compared with plastics, and the associated improved heat removal of a metallic protective cap 20, condensation effects acting on the fuel occur. After the internal combustion engine (and hence also the fuel injection system) has been shut down, therefore, the evaporation of the low boiling-point constituents of the fuel is substantially reduced and with it, the deposition of the higher boiling-point constituents in the annular gap 36. The danger of deposits in the region of the two, for example, injection openings 16 and the passage opening 29 of the protective cap 20 is additionally further reduced.

Simple and low-cost manufacture of a metallic protective cap 20 according to the invention is made possible by forming the protective cap 20, including the protrusions 30, the retention collar 40 and the dimples 41, by sheet metal shaping. The thickness of the sheet metal to be shaped is, for example, 0.5 mm. It is, however, also possible to form the metal protective cap 20 by machining.

The protective cap 20 fastened to the nozzle body 1 of the fuel injection valve not only acts to protect the at least one injection opening 16 from damage and from the deposit of particles but acts also to avoid deposits of higher boiling-point constituents of the fuel in the region of the at least one injection opening 16 and the passage opening 29 because the narrow annular gap 36 exerts a capillary effect on the fuel and the higher boiling-point constituents of the fuel are deposited in this gap.

The foregoing relates to a preferred exemplary embodiment of the invention, it being understood that other variants and embodiments thereof are possible within the spirit and scope of the invention, the latter being defined by the appended claims.

We claim:

1. A fuel injection valve having a nozzle body, a one-piece pan-shaped protective cap fastened to said nozzle body, said pan-shaped protective cap is provided with a bottom which has a passage opening extending approximately concentrically about a longitudinal axis of said fuel injection valve and opens towards at least one fuel injection opening, at least one gap formed between the bottom of the protective cap and an end surface of the fuel injection valve, said at least one gap opens toward the passage opening, the protective cap (20) is provided with at least three axially directed protrusions (30) formed as a part of the bottom (28) and which protrudes with a predetermined axial distance (31) in a direction of the fuel injection valve for contact with the end surface (35) of the fuel injection valve.

2. A fuel injection valve according to claim 1, in which the protective cap (20) has a radially outwards protruding retention collar (40) spaced axially from the bottom (28), in which at least two dimples (41) are formed.

3. A fuel injection valve according to claim 2, in which the axial distance (31) is small relative to the diameter of the passage opening (29) of the protective cap (20).

4. A fuel injection valve having a nozzle body, a thin orifice plate (15) tightly secured to an outlet end of said nozzle body, said thin orifice plate including at least one fuel injection opening (10), a pan-shaped protective cap fastened to said nozzle body, said pan-shaped protective cap is provided with a bottom which has a passage opening extending approximately concentrically about a longitudinal axis of said valve and opens towards said at least one fuel injection opening, at least one gap formed between the bottom of the protective cap and said thin orifice plate secured to an outlet end surface of the fuel injection valve, said at least one gap opens toward the passage opening, the protective cap (20) is provided with at least three axially directed protrusions (30) formed from the bottom (28) and protruding with a predetermined axial distance (31) in a direction of the fuel injection valve in contact with the thin orifice plate secured to an outlet end surface (35) of the fuel injection valve.

5. A fuel injection valve according to claim 4, in which the protective cap (20) has a radially outwards, protruding retention collar (40) spaced axially from the bottom (28), in which at least two dimples (41) are formed.

6. A fuel injection valve according to claim 4, in which the gap (36) is subdivided into sectors by the protrusions (30).

7. A fuel injection valve according to claim 6, in which the protective cap (20) has a radially outwards protruding retention collar (40) spaced axially from the bottom (28), in which at least two dimples (41) are formed.

8. A fuel injection valve according to claim 7, in which the axial distance (31) is small relative to the diameter of the passage opening (29) of the protective cap (20).

9. A fuel injection valve according to claim 8, in which the axial distance (31) is small relative to the diameter of the passage opening (29) of the protective cap (20).

10. A fuel injection valve according to claim 4, in which the protective cap (20) is formed from a metallic material.

11. A fuel injection valve according to claim 10, in which the axial distance (31) is small relative to the diameter of the passage opening (29) of the protective cap (20).

12. A fuel injection valve according to claim 4, in which the protective cap (20) is formed by sheet metal shaping.

13. A fuel injection valve according to claim 12, in which the axial distance (31) is small relative to the diameter of the passage opening (29) of the protective cap (20).

14. A fuel injection valve according to claim 4, in which the protective cap (20) is connected to the nozzle body (1) by indentations.

15. A fuel injection valve according to claim 14, in which the axial distance (31) is small relative to the diameter of the passage opening (29) of the protective cap (20).

16. A fuel injection valve according to claim 4, in which at least two inwardly protruding retention tongues (25) are formed on a periphery of the protective cap (20), these retention tongues (25) engaging in an annular groove (23) of the nozzle body (1).

17. A fuel injection valve according to claim 16, in which the axial distance (31) is small relative to the diameter of the passage opening (29) of the protective cap (20).

18. A fuel injection valve according to claim 4, in which at least two inwardly protruding engagement steps (22) are formed on a periphery of the protective cap (20), these engagement steps (22) engaging in an annular groove (23) of the nozzle body (1).

19. A fuel injection valve according to claim 18, in which the axial distance (31) is small relative to the diameter of the passage opening (29) of the protective cap (20).

20. A fuel injection valve according to claim 4, in which the axial distance (31) is small relative to the diameter of the passage opening (29) of the protective cap (20).

* * * * *